United States Patent [19]

Shibazaki et al.

[11] Patent Number: 4,711,080

[45] Date of Patent: Dec. 8, 1987

[54] SPUN YARN AND METHOD AND APPARATUS FOR FORMING SPUN YARN

[75] Inventors: Toshimi Shibazaki, Takarazuka; Teruo Nakayama, Ohtsu, both of Japan

[73] Assignee: Murata Kikai Kabushiki Kaisha, Kyoto, Japan

[21] Appl. No.: 826,284

[22] Filed: Feb. 5, 1986

[30] Foreign Application Priority Data

Feb. 8, 1985 [JP] Japan ..... 60-23960

[51] Int. Cl.[4] ..... D02G 3/00; D02G 3/38; D02G 1/16

[52] U.S. Cl. ..... 57/207; 57/208; 57/224; 57/328; 57/12

[58] Field of Search ..... 57/5, 6, 207, 327, 328, 57/333, 350, 351, 208, 210, 224, 12

[56] References Cited

U.S. PATENT DOCUMENTS

| | | | |
|---|---|---|---|
| 3,691,750 | 9/1972 | Waters | 57/207 X |
| 3,992,865 | 11/1976 | Tuchida et al. | 57/81 X |
| 4,051,660 | 10/1977 | Griset | 57/351 X |
| 4,304,092 | 12/1981 | Bridges | 57/207 |
| 4,399,648 | 8/1983 | Kato | 57/328 X |
| 4,467,594 | 8/1984 | Eschenbach | 57/207 |
| 4,484,436 | 11/1984 | Nakayama et al. | 57/328 |
| 4,489,542 | 12/1984 | Buzano et al. | 57/328 X |
| 4,495,757 | 1/1985 | Dimitrov | 57/328 X |
| 4,495,761 | 1/1985 | Nakayama et al. | 57/328 |
| 4,497,167 | 2/1985 | Nakahara et al. | 57/328 |
| 4,584,830 | 4/1986 | Faure et al. | 57/328 |

FOREIGN PATENT DOCUMENTS

| | | | |
|---|---|---|---|
| 55737 | 7/1977 | Japan | 57/328 |

*Primary Examiner*—Donald Watkins

*Attorney, Agent, or Firm*—Spensley Horn Jubas & Lubitz

[57] ABSTRACT

A bound spun yarn comprising substantially twistless core fibers and wound fibers wound spirally around the core fibers. The core fibers and the wound fibers have colors different from each other and the number of the wound fibers vary randomly in a longitudinal direction of the yarn.

22 Claims, 14 Drawing Figures

SPUN YARN AND METHOD AND APPARATUS FOR FORMING SPUN YARN

FIELD OF THE INVENTION AND RELATED ART STATEMENT

The present invention relates to a spun yarn and more particularly to a spun yarn having two or more colors.

A cloth woven with a yarn having plural colors is gentler in the variation of colors and superior in appearance as compared with a cloth woven by a combination of yarns each having a single color, and for this reason such cloth has been popular for making clothing, curtains, etc. Upon observation of such type of yarns it is seen that in one yarn are mixed fibers of different colors substantially uniformly, while in another are intertwisted a plurality of yarns having different colors.

The former yarn just mentioned above presents nearly one mixed color as a whole because the colors of the fibers are commingled densely. For example, in the case where white and black fibers are dispersed and mixed to constitute a single yarn, the yarn is deficient in the variation of color, which is nearly gray. The latter yarn is also monotonous and deficient in variation because the colors alternately appear regularly at short pitches in a longitudinal direction of the yarn.

OBJECT AND SUMMARY OF THE INVENTION

It is an object of the present invention to provide a yarn full of color variation.

The yarn of the present invention is a bound spun yarn comprising twistless core fibers and wound fibers would round the core fibers. The core fibers and the wound fibers have colors different from each other such as white and black, for example, and the number of the wound fibers varies randomly in a longitudinal direction of the yarn.

In the yarn of the invention, if the core fibers are white and the wound fibers black, the portion rich in the wound fibers presents black color and the portion poor in such fibers present white color, thus presenting alternate changes in color in the longitudinal direction. Further, since those portions vary randomly in length, the yarn becomes rich in variation of color.

DETAILED DESCRIPTION OF PREFERRED EMBODIMENTS

Figure 1:
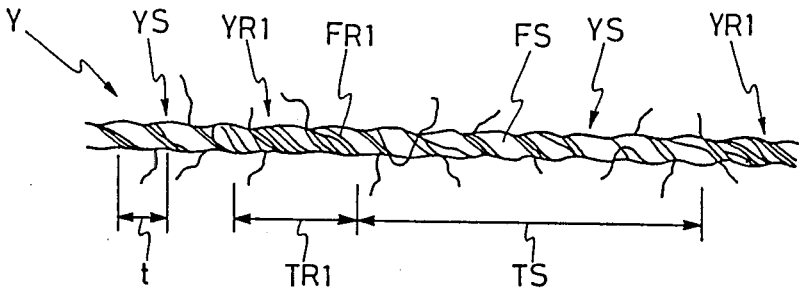
FIGS. 1 to 4 illustrate yarns embodying the invention.

FIG. 1 shows an embodiment of a spun yarn according to the present invention. Yarn Y is composed of twistless core fibers FS of white color and wound fibers FR1 of black color wound spirally around the outer periphery of the core fibers FS. The core fibers FS are substantially twistless and are arranged approximately in parallel in the longitudinal direction of the yarn Y. A slight soft twist may remain in the core fibers. The wound fibers FR1 are wound approximately in the same direction in a dispersed state from each other. Besides, the wound fibers FR1 wound round the core fibers FS at nearly equal intervals t to bind the core fibers FS and form a portion YR1 where a relatively large number of the fibers are wound round the core fibers and a portion YS with a relatively small number of the fibers wound, alternately in the longitudinal direction of the yarn Y. Lengths TR1 and TS of the portions YR1 and YS appear randomly in the longitudinal direction of the yarn, so that the yarn assumes black at the portion YR1 rich in the wound fibers FR1 and a color close to white at the portion YS poor in such fibers.

Figure 2:
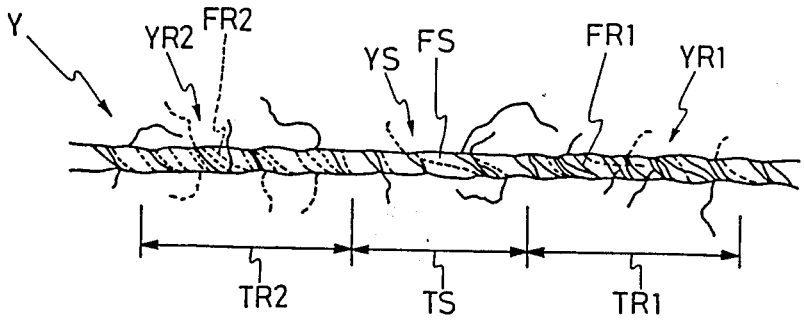

FIG. 2 shows another example of a spun yarn according to the present invention. This yarn Y is composed of twistless core fibers FS of white color, first wound fibers FR1 of black color wound spirally around the core fibers FS, indicated by solid lines, and second wound fibers FR2 of red color indicated by broken lines. On the yarn Y there appear randomly a portion YR1 having a large number of the first wound fibers, a portion YR2 having a large number of the second wound fibers and a portion YS where the wound fibers FR1 and FR2 are reduced in number. Lengths TS, TR1 and TR2 of those portions are also random. Consequently, the yarn Y becomes a multi-color yarn having white, black, red colors and a mixture thereof arranged randomly in the longitudinal direction of the yarn.

Figure 3:
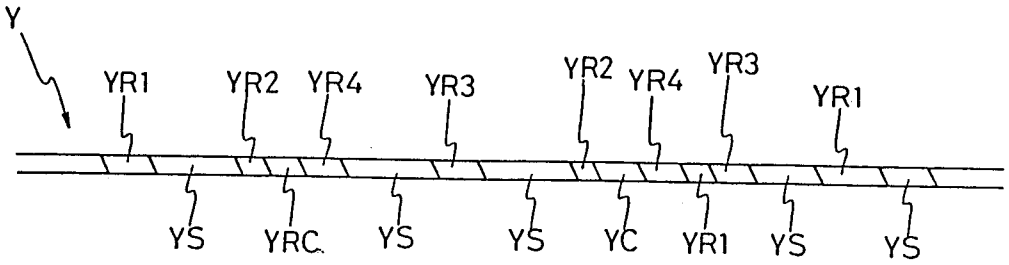

FIG. 3 schematically illustrates a further example of a spun yarn according to the present invention. This yarn Y is composed of white core fibers, first wound fibers of black color, second wound fibers of red color, third wound fibers of blue color and fourth wound fibers of yellow color. On the yarn Y there appear randomly a portion YR1 having a large number of the first wound fibers, a portion YR2 having a large number of the second wound fibers, a portion YR3 having a large number of the third wound fibers, a portion YR4 having a large number of the fourth wound fibers, a portion YS having a reduced number of wound fibers, a portion YC where various wound fibers are commingled.

Figure 4:
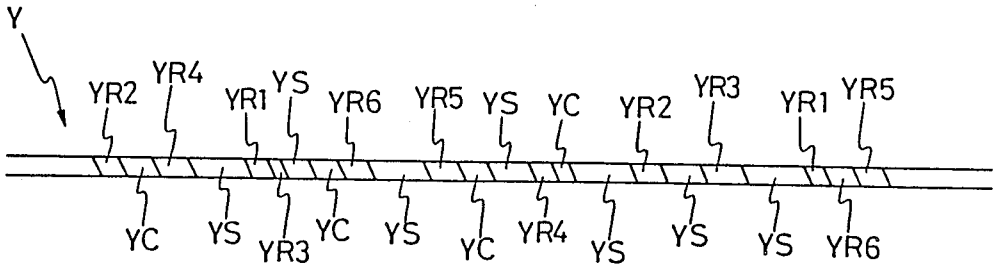

FIG. 4 shows a spun yarn Y which includes more kinds (six kinds) of wound fibers than those shown in FIG. 3.

The yarn of the present invention may be of a construction wherein the fibers FS, FR1 and FR2 have different dyeing properties and are developed into different colors by dyeing after manufacture of the yarn Y. Moreover, the number of the wound fibers FR1 and FR2 may be increased so that the fibers are wound substantially throughout the outer periphery of the core fibers to the extent of the core fibers being not easily visible. In this case, only the colors of the wound fibers are visible, so the wound fibers alone may be dyed into desired colors at the time of manufacture of the yarn. Further, the core and wound fibers of the spun yarn of the invention may be of different materials. For example, the core fibers may be cotton superior in hygroscopicity, while the wound fibers may be synthetic fibers such as polyester poor in hygroscopicity, whereby the yarn becomes suitable for sports wears and underwears.

The following description is provided about how to obtain the spun yarn of the present invention.

Figure 5A:
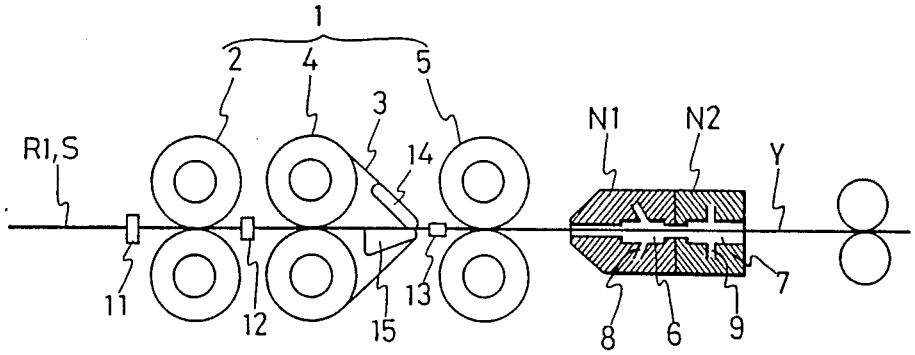
FIGS. 5*a* and 5*b* illustrate how to obtain the yarn shown in FIG. 1.
Figure 5B:
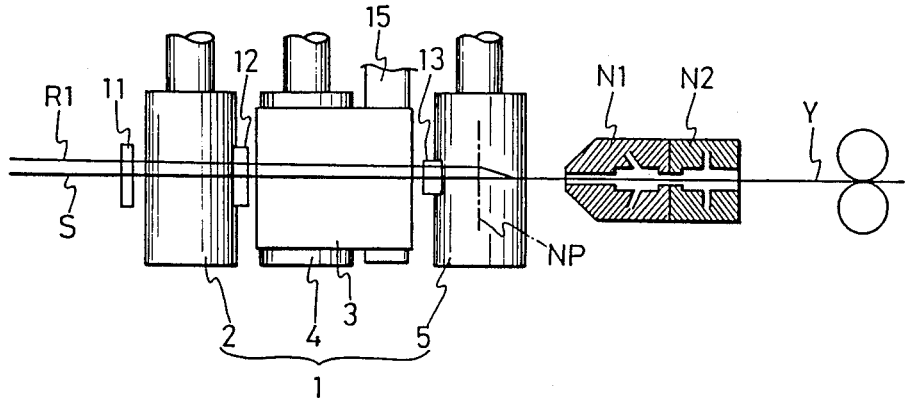

In FIGS. 5*a* and 5*b*, the reference numeral 1 denotes a draft device provided with a pair of back rollers 2, a pair of middle rollers 4 each having an apron 3, and a pair of front rollers 5. In front of the front rollers 5 are disposed first and second nozzles N1 and N2 in this order. The nozzles N1 and N2 are provided with yarn passages 6, 7 and air spouts 8, 9 for ejecting compressed air toward the interiors of the yarn passages 6 and 7. The spouts 8 and 9 function to let oppositely rotating air streams act on the yarn in the yarn passages 6 and 7. The rotating force of the air stream in the second nozzle N2 is stronger than that in the first nozzle. Those air streams also function to suck the yarn. Consequently, the second nozzle N2 imparts a false twist to the yarn in the yarn passage 7, while the first nozzle N1 balloons the yarn in the yarn passage 6 in a direction opposite to the above false twist. Nip centers of the rollers 2, 4, 5 and the yarn passages 6, 7 are aligned. Further, fiber bundle guides 11, 12 and 13 are disposed respectively behind the back rollers 2, between the back rollers 2 and the middle rollers 4, and between the middle rollers 4 and the front rollers 5. The numerals 14 and 15 denote apron guides for providing a contact pressure between the aprons 3.

Figure 6A:
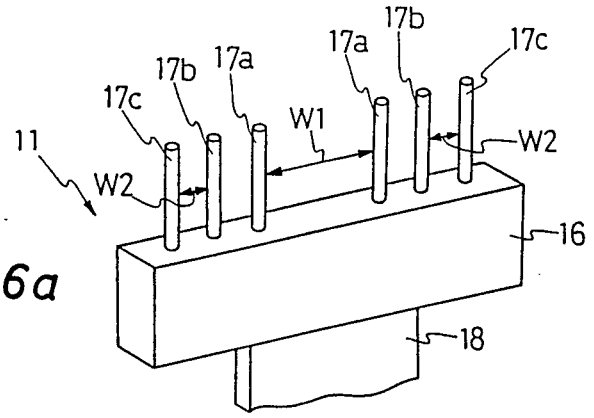
FIGS. 6*a*, 6*b* and 6*c* are perspective views of fiber bundle guides.
Figure 6B:
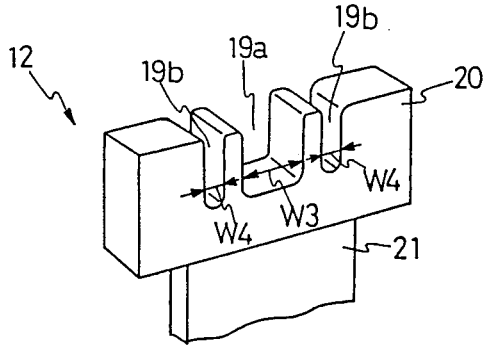
Figure 6C:
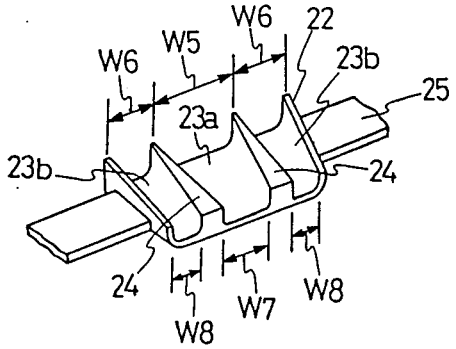
Figure 7:
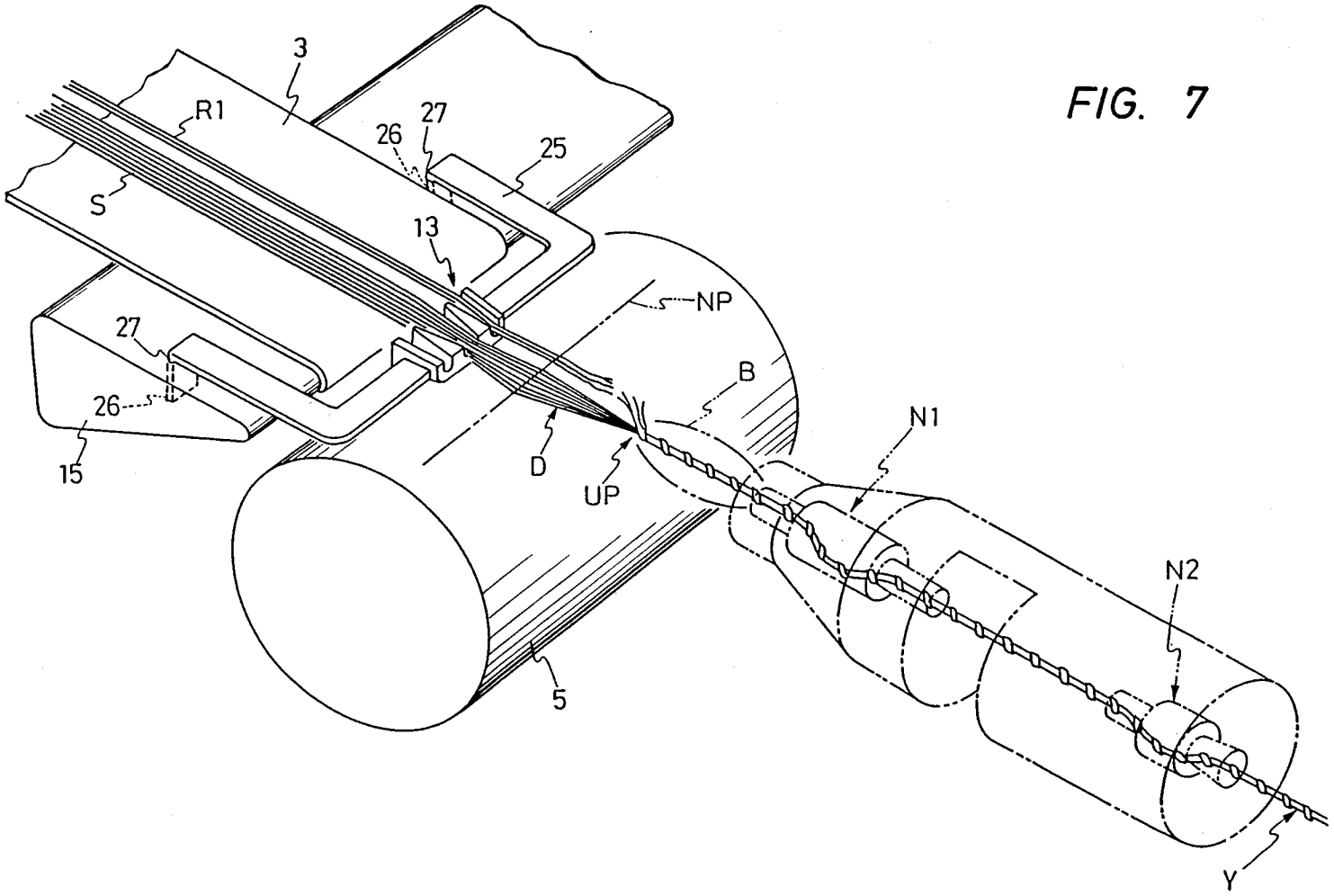
FIG. 7 is a perspective view showing a third fiber bundle guide and its vicinity.

The fiber bundle guides 11, 12 and 13 are of such structures as shown in FIGS. 6*a*, 6*b* and 6*c*. First fiber bundle guide 11 comprises a block 16 and six pins 17*a*, 17*b* and 17*c* implanted upright in the block 16. It is fixed to a machine frame (not shown) through a plate 18. The inside pins 17*a* are spaced from each other at a width W1 sufficient to permit a silver from a drawing frame to pass therethrough. The other pins 17*b* and 17*c* are spaced from each other at a width W2 sufficient to permit a roving from a flyer frame to pass therethrough. The second fiber bundle guide 12 has a first groove 19*a* formed centrally in an upper surface of the block 20, the first groove 19*a* having a width W3 slightly smaller than the width W1, and second grooves 19*b* formed on both sides of the groove 19*a*, the second grooves 19*b* having a width W4 slightly smaller than the width W2. The second fiber bundle guide 12 is fixed to the machine frame through a plate 21. The third fiber bundle guide 13 comprises a groove 23*a* formed centrally in an upper surface of a block 22 and grooves 23*b* formed on both sides of the groove 23*a*. The grooves 23*a* and 23*b* have widths W7 and W8 of their front portions, namely, portions close to the front rollers 5, and also have widths W5 and W6 of their rear portions, the widths W7 and W8 being smaller than the widths W5 and W6. The grooves 23*a* and 23*b* are separated from one another through separation walls 24 which are in the form of a triangular prism having a vertex at the above rear portion. The rear widths W5 and W6 are slightly smaller than or about the same as the widths W3 and W4, respectively, of the second fiber bundle guide 12. A support structure for the third fiber bundle guide 13 is shown in FIG. 7, in which a bracket-shaped support plate 25 is fixed to both sides of the guide 13, and bent ends 26 are formed at both ends of the plate 25. The bent ends 26 are fitted in mounting holes 27 formed in the bottom-side apron guide 15, whereby the third fiber bundle guide 13 is fixed removably as shown in the figure.

In FIGS. 5*a* and 5*b*, the reference mark S represents a white twistless sliver provided from a drawing frame, the sliver S being disposed on a central axis of the first nozzle N1, namely, on a straight line joining the yarn passages 6, 7 and the nip centers of the rollers 2, 4, 5. The fiber bundle guides 11, 12 and 13 are so disposed as to maintain the sliver S in the above position. The sliver S is inserted between the pins 17*a* of the first fiber bundle guide 11, into the groove 19*a* of the second fiber bundle guide 12 and further into the groove 23*a* of the third fiber bundle guide 13. The mark R1 represents a roving provided from a flyer frame, the roving R1 having a soft twist and being dyed in black. The roving R1 is inserted between the pins 17*b* and 17*c*, into the groove 19*b* of the second fiber bundle guide 12 and further into the groove 23*b* of the third fiber bundle guide 13. Within the draft device 1 the roving R1 is disposed approximately in parallel with the sliver S. The roving R1 passes through a nip point NP of the front rollers 5, thereafter bends and is conducted to the first nozzle N1, then moves through the yarn passages 6 and 7 together with the sliver S. The sliver S which has passed the front rollers 5 is false-twisted by the second nozzle N2. This false twist is propagated up to a position close to the front rollers 5 while leaving a triangular portion D of the sliver S. The first nozzle N1 balloons the sliver S in a direction opposite to the above twist as indicated by a dash-double dot line B. At this time, the roving R1 is also ballooned together with the sliver S. The roving R1 is in a position deviated a predetermined distance from the central axis of the first nozzle N1, so it does not so greatly experience the above false twist and is almost in a twistless state. Besides, since it is under the strongest tension due to the above ballooning, the constituent fibers of the roving R1 are separated and wound round the sliver S in the same direction as the balloon. This fiber winding is effected so that at a united point UP of the roving R1 and the sliver S, one ends of the separated fibers are twisted into the sliver S, while the remaining portions are wound round the sliver. The thus-united fiber bundles S and R1 are subjected to untwisting upon leaving the second nozzle N2, whereby the sliver S reverts to its original twistless state and at the same time the roving R1 is twisted in its winding direction and wound round the sliver more strongly to afford a single spun yarn Y.

The spun yarn Y thus produced has the structure shown in FIG. 1. The core fibers FS are constituted by the sliver S having a relatively large number of fibers and the wound fibers FR1 are constituted by the roving R1 which is relatively small in the number of fibers. Therefore, the core fibers FS are not completely covered with the wound fibers FR1, but many portions of the outer layer are exposed. Thus, in the appearance of this spun yarn Y, the white core fibers FS and the black wound fibers FR 1 are visible at a time, and the yarn as a whole assumes gray color. In this connection, however, since the foregoing balloon created by the first nozzle N1 varies delicately with the lapse of time, the number of the wound fibers FR1 in the longitudinal direction of the yarn Y varies randomly to form alternately the portion VR1 having a relatively large number of the wound fibers FR1 and the portion YS which is relatively small in the number of the wound fibers, thus resulting in a two color system of black and white which appear alternately. The number of fibers per unit length of the roving R1 is sufficiently smaller in comparison with the sliver S, so even if the number of the wound fibers FR1 changes in the longitudinal direction of the yarn Y, there will be little change in the yarn thickness. The yarn Y is further advantageous in that it is possible to let the color of the roving R1 appear effeciently on the yarn Y because the greater part of the roving R1 is constituted by the wound fibers FR1. In the manufacture of the yarn Y, the roving R1 and the sliver S are preferably moved in a separated state without being mixed with each other in the draft device 1. To this end, the fiber bundle guides 11, 12 and 13 are needed. Particularly, the second fiber bundle guide 12 is effective for separating the fiber bundles R1 and S from each other. Without the guide 12, the fiber bundles R1 and S would lap each other during draft, making it impossible to obtain the desired yarn Y.

Figure 8:
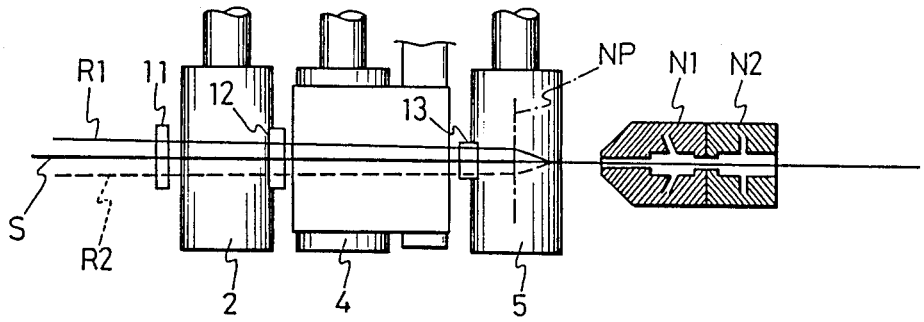
FIGS. 8 to 10 illustrate how to obtain the yarns shown in FIGS. 2 to 4.

FIG. 8 illustrates how to obtain the spun yarn shown in FIG. 2. According to this method, the draft device 1, nozzles N1, N2 and fiber bundle guides 11, 12 and 13 are disposed in the same positions as in FIGS. 5*a* and 5*b*, and a white sliver S and a first roving R1 of black color are allowed to move in the same manner as in FIGS. 5*a* and 5*b*, further a second roving R2 of red color is inserted through the fiber bundle guides 11, 12 and 13 in positions opposite to the first roving R1. After leaving the front rollers 5, the second roving R2 is subjected to the action of the first nozzle N1, whereby it is wound round the silver S together with the first roving R1.

Figure 9:
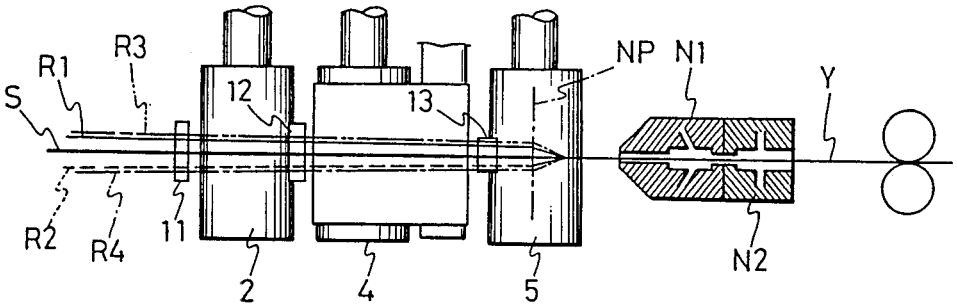

Referring to FIG. 9, there is illustrated how to obtain the spun yarn Y shown in FIG. 3, in which in addition to the white silver S, first black roving R1 and second red roving R2, there are used a third roving R3 of blue color indicated by a dash-double dot line and a fourth roving R4 of yellow color indicated by a dash-dot line. The first and third rovings R1 and R3 may be inserted through the fiber bundle guides 11–13 in the same positions, and the second and fourth rovings R2 and R4 can also be inserted through the fiber bundle guides 11–13 in the same position. Alternatively, guide means for separately guiding the third and fourth rovings R3 and R4 may be provided above the fiber bundle guides 11–13.

Figure 10:
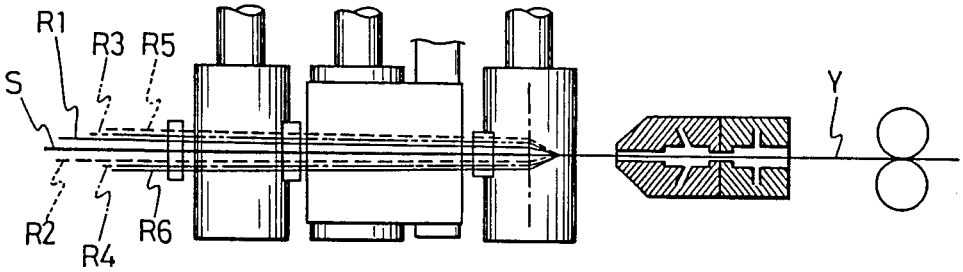

Referring to FIG. 10, there is illustrated how to obtain the yarn Y shown in FIG. 4, in which in addition to the first to fourth rovings R1–R4 shown in FIG. 9 there are used a fifth roving R5 of green color and a sixth roving R6 of gold color, whereby at least seven kinds of color portions YR1–YR6, YS, YC usually appear on the yarn Y.

Figure 11:
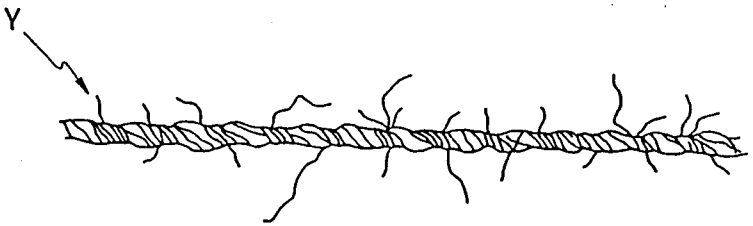
FIG. 11 shows a still further example of yarn obtained according to any of the above methods.

In the methods shown in FIGS. 5 and 8 to 10, if the rovings R1–R6 are all black and the number of fibers per unit length of the rovings is made relatively large, the resulting yarn Y has such a structure as shown in FIG. 11, in which the outer periphery of the core fibers FS is thickly coated with wound fibers of black color. Consequently, this yarn Y is nearly black in appearance and thus the yarn can be set to a desired color by changing the color of the rovings R1–R6 without dyeing the silver S itself.

The spun yarn of the present invention is rich in color variation and exhibits a chromatic effect not found in conventional yarns, so it is suitable for clothing and interior decorative cloths.

What is claimed is:

1. A bound spun yarn comprising substantially twistless core fibers and wound fibers wound spirally around the core fibers, said core fibers and said wound fibers differing from one another with respect to at least one physical characteristic, the number of said wound fibers varying randomly in the longitudinal direction of the yarn.

2. The bound yarn as claimed in claim 1, wherein said core fibers comprise a first fiber bundle having a relatively large number of fibers and said wound fibers comprise a second fiber bundle having a relatively small number of fibers, whereby the core fibers are not completely covered by the wound fibers.

3. The bound yarn as claimed in claim 1, wherein said core fibers and said wound fibers differ in color from each other.

4. The bound yarn as claimed in claim 1, wherein said core fibers and said wound fibers are comprised of different materials from each other.

5. The bound yarn as claimed in claim 3, wherein said core fibers and said wound fibers have different dying properties, whereby said core fibers and said wound fibers may be dyed different colors after manufacture of the spun yarn.

6. A method for producing a spun yarn by passing a fiber bundle drafted by a draft device through yarn passages of a first nozzle and a second nozzle having air spouts for ejecting compressed air therein, said spouts of the second nozzle being set to produce an oppositely rotating air stream to that in the first nozzle, characterized in that a first twistless fiber bundle being disposed on a central axis of the draft device and a second fiber bundle inserted in the draft device separately from said first fiber bundle are introduced into the first nozzle together to produce a bound spun yarn having substantially twistless core fibers derived from said first fiber bundle and wound fibers derived from said second fiber bundle, said wound fibers being wound spirally around the core fibers.

7. The method for producing a spun yarn as claimed in claim 6, wherein said central axis of the draft device and the axes of the yarn passages of the first and second nozzles are aligned.

8. The method for producing a spun yarn as claimed in claim 6, wherein said draft device includes a pair of back rollers, a pair of middle rollers and a pair of front rollers and wherein a first fiber bundle guide for guiding the first and second fiber bundles is disposed on the sliver supply side of the back rollers, a second fiber bundle guide is disposed between the back rollers and the middle rollers, and a third fiber bundle guide is disposed between the middle rollers and the front rollers, and the first fiber bundle and the second fiber bundle are disposed approximately in parallel and are drafted separately from each other.

9. The method for producing a spun yarn as claimed in claim 8, wherein each of said first, second and third fiber bundle guides has a guide groove associated therewith and wherein the widths of the guide grooves of the fiber bundle guides become gradually smaller from the back rollers toward the front rollers.

10. A spun yarn prepared by a method comprising the steps of; passing a fiber bundle drafted by a draft device through yarn passages of a first nozzle and a second nozzle having air spouts for ejecting compressed air therein, said spouts of the second nozzle being set to produce an oppositely rotating air stream to that in the first nozzle, characterized in that a first twistless fiber bundle being disposed on a central axis of the draft device and a second fiber bundle inserted in the draft device separately from said first fiber bundle are introduced into the first nozzle together to produce a bound spun yarn having substantially twistless core fibers derived from said first fiber bundle and wound fibers derived from said second fiber bundle, said wound fibers being wound spirally around the core fibers.

11. A spun yarn prepared by a method comprising the steps of: passing a fiber bundle drafted by a draft device through yarn passages of a first nozzle and a second nozzle having air spouts for ejecting compressed air therein, said spouts of the second nozzle being set to produce an oppositely rotating air stream to that in the first nozzle, characterized in that a first twistless fiber bundle being disposed on a central axis of the draft device and a second fiber bundle inserted in the draft device separately from said first fiber bundle are introduced into the first nozzle together to produce a bound spun yarn having substantially twistless core fibers derived from said first fiber bundle and wound fibers derived from said second fiber bundle, said wound fibers being wound spirally around the core fibers, wherein said central axis of the draft device and the axes of the yarn passages of the first and second nozzles are aligned.

12. A spun yarn prepared by a method comprising the steps of: passing a fiber bundle drafted by a draft device through yarn passages of a first nozzle and a second nozzle having air spouts for ejecting compressed air therein, said spouts of the second nozzle being set to produce an oppositely rotating air stream to that in the first nozzle, characterized in that a first twistless fiber bundle being disposed on a central axis of the draft device and a second fiber bundle inserted in the draft device separately from said first fiber bundle are introduced into the first nozzle together to produce a bound spun yarn having substantially twistless core fibers derived from said first fiber bundle and wound fibers derived from said second fiber bundle, said wound fibers being wound spirally around the core fibers, wherein said draft device includes a pair of back rollers, a pair of middle rollers and a pair of front rollers and wherein a first fiber bundle guide for guiding the first and second fiber bundles is disposed on the sliver supply side of the back rollers, a second fiber bundle guide is disposed between the back rollers and the middle rollers, and a third fiber bundle guide is disposed between the middle rollers and the front rollers, and the first fiber bundle and the second fiber bundle are disposed approximately in parallel and are drafted separately from each other.

13. A spun yarn prepared by a method comprising the steps of: passing a fiber bundle drafted by a draft device through yarn passages of a first nozzle and a second nozzle having air spouts for ejecting compressed air therein, said spouts of the second nozzle being set to produce an oppositely rotating air stream to that in the first nozzle, characterized in that a first twistless fiber bundle being disposed on a central axis of the draft device and a second fiber bundle inserted in the draft device separately from said first fiber bundle are introduced into the first nozzle together to produce a bound spun yarn having substantially twistless core fibers derived from said first fiber bundle and wound fibers derived from said second fiber bundle, said wound fibers being wound spirally around the core fibers, wherein said draft device includes a pair of back rollers, a pair of middle rollers and a pair of front rollers and wherein a first fiber bundle guide for guiding the first and second fiber bundles is disposed on the silver supply side of the back rollers, a second fiber bundle guide is disposed between the back rollers and the middle rollers, and a third fiber bundle guide is disposed between the middle rollers and the front rollers, and the first fiber bundle and the second fiber bundle are disposed approximately in parallel and are drafted separately from each other, wherein each of said first, second and third fiber bundle guides has a guide groove associated therewith and wherein the widths of the guide grooves of the fiber bundle guides become gradually smaller from the back rollers toward the front rollers.

14. A method for producing a spun yarn comprising the steps of:

drafting a first fiber bundle in a drafting device;

separately drafting a second fiber bundle in a drafting device;

subjecting said first and second fiber bundles simultaneously to the action of a first nozzle having an air spout for producing a first rotating air stream;

subjecting said first and second fiber bundles simultaneously to the action of a first nozzle having an air spout for producing a second rotating air stream, said air spout of said first nozzle and said air spout of said second nozzle being disposed so that said first rotating air stream and said second rotating air stream rotate in substantially opposite directions;

whereby a spun yarn having substantially twistless core fibers derived from said first fiber bundle and wound fibers derived from said second fiber bundle is produced.

15. A method as in claim 14 wherein said drafting device, said first nozzle and said second nozzle are aligned along a common axis and wherein said drafting device further includes at least one fiber bundle guide aligned along the common axis of said drafting device, said first nozzle and said second nozzle, said first fiber bundle guide including a first guide groove for guiding said first fiber bundle and a second guide groove for guiding said second fiber bundle.

16. A spun yarn prepared by a process comprising the steps of:

drafting a first fiber bundle in a drafting device;

separately drafting a second fiber bundle in a drafting device;

subjecting said first and second fiber bundles simultaneously to the action of a first rotating air stream;

subjecting said first and second fiber bundles simultaneously to the action of a second rotating air stream, said first rotating air stream and said second rotating air stream rotating in substantially opposite directions, whereby a bound spun yarn having substantially twistless core fibers derived from said first fiber bundle and wound fibers derived from said second fiber bundle is produced.

17. A method for producing a spun yarn comprising the steps of:

drafting a first fiber bundle in a drafting device;

separately drafting a second fiber bundle in a drafting device;

subjecting said first and second fiber bundles simultaneously to the action of a first rotating air stream;

subjecting said first and second fiber bundles simultaneously to the action of a second rotating air stream, said first rotating air stream and said second rotating air stream rotating in substantially opposite directions, whereby a spun yarn having substantially twistless core fibers derived from said first fiber bundle and wound fibers derived from said second fiber bundle is produced.

18. A method as in claim 17 wherein said first fiber bundle is in alignment with the rotational axis of said first rotating air stream.

19. A device for producing spun yarn comprising:

a drafting device comprising a pair of back rollers, a pair of middle rollers, and a pair of front rollers;

a first nozzle having an air spout for producing a first rotating air stream;

a second nozzle having an air spout for producing a second rotating air stream, said air spout of said first nozzle and said air spout of said second nozzle being disposed so that said first rotating air stream and said second rotating air stream rotate in substantially opposite directions;

said drafting device, said first nozzle and said second nozzle being aligned along a common axis, said device further comprising:

a first fiber bundle guide disposed substantially adjacent said pair of back rollers;

a second fiber bundle guide disposed between said pair of back rollers and said pair of middle rollers; and a third fiber bundle guide disposed between said pair of middle rollers and said pair of front rollers, said first, second and third bundle guides being aligned along the common axis of said drafting device, said first nozzle and said second nozzle.

20. A device as in claim 19, wherein said first fiber bundle guide includes a first guide groove for guiding a first fiber bundle and a second guide groove for guiding a second fiber bundle, said second fiber bundle guide includes a first guide groove for guiding a first fiber bundle and a second guide groove for guiding a second fiber bundle, and said third fiber bundle guide includes a first guide groove for guiding a first fiber bundle and a second guide groove for guiding a second fiber bundle.

21. A device as in claim 20, wherein the width of the first guide groove of the first fiber bundle guide is larger than the width of the first guide groove of the second fiber bundle guide and wherein the width of the first guide groove of the second fiber bundle guide is larger than the width of the first guide groove of the third fiber bundle guide.

22. A device as in claim 20, wherein the first guide groove of the first fiber bundle guide, the first guide groove of the second fiber bundle guide and the first guide groove of the third fiber bundle guide are aligned along the common axis of the drafting device, the first nozzle and the second nozzle.

* * * * *